US007312566B2

(12) United States Patent
Foo

(10) Patent No.: US 7,312,566 B2
(45) Date of Patent: Dec. 25, 2007

(54) LONG AFTERGLOW LAMP SHEATH AND LAMP ASSEMBLY USING THE SAME

(75) Inventor: Onn Fah Foo, Kowloon (CN)

(73) Assignee: Mass Technology (H.K.) Limited, Kowloon, Hong Kong (CN)

( * ) Notice: Subject to any disclaimer, the term of this patent is extended or adjusted under 35 U.S.C. 154(b) by 0 days.

(21) Appl. No.: 11/136,679

(22) Filed: May 24, 2005

(65) Prior Publication Data

US 2005/0264159 A1 Dec. 1, 2005

(30) Foreign Application Priority Data

May 26, 2004 (CN) ..... 2004 2 0065267 U
Aug. 19, 2004 (CN) ..... 2004 1 0055331

(51) Int. Cl.
*H01J 61/94* (2006.01)
*H01J 1/62* (2006.01)
*H01J 61/35* (2006.01)
*H01J 5/16* (2006.01)

(52) U.S. Cl. ..... 313/489; 313/112; 313/110; 313/635; 313/486

(58) Field of Classification Search ..... 313/1, 313/485–487, 489, 635, 110, 112; 362/224, 362/225

See application file for complete search history.

(56) References Cited

U.S. PATENT DOCUMENTS 4,908,055 A * 3/1990 Komiya et al. ..... 65/77
6,479,936 B1 * 11/2002 Martinez ..... 313/635
6,623,670 B2 * 9/2003 Tasaki et al. ..... 264/2.5
2005/0205874 A1 * 9/2005 Liu et al. ..... 257/79

* cited by examiner

*Primary Examiner*—Mariceli Santiago
*Assistant Examiner*—Anne M Hines
(74) *Attorney, Agent, or Firm*—Alix, Yale & Ristas, LLP

(57) ABSTRACT

The present invention provides a long afterglow lamp that comprises a lamp body, characterized in that a light penetrating long afterglow rubber sheath is sleeved outside the body. The present invention is simple in structure thus greatly facilitating the manufacturing process. Ultraviolet light or visible light from the light source of the lamp body is absorbed by the long afterglow fluorescent powder in the long afterglow fluorescent rubber sheath. When the lamp body turns off, the long afterglow fluorescent powder in the long afterglow fluorescent rubber sheath can still keep glowing for a period of time, to provide an illuminating or indicating function.

16 Claims, 4 Drawing Sheets

LONG AFTERGLOW LAMP SHEATH AND LAMP ASSEMBLY USING THE SAME

TECHNICAL FIELD

The present invention relates to an illuminating lamp, which has a long fluorescent lag characteristic, and in particular a long afterglow lamp that can keep glowing for a period of time after the power turns off.

BACKGROUND OF THE INVENTION

Along with the progress of technology, the illuminating performance of compact type fluorescent lamps has already met the requirements for illumination and such lamps have been employed in various places. The long afterglow illuminating materials are widely used in indicative situations that include those in the realm of fire service, marine vessel, architecture, traffic, railroad and military or the like.

In the realm of the fire service, an indication of an escape way can provide guide directions and allow people in an emergency to find the way out whenever an emergency or a power breakdown occurs. However, it is not enough to have only the indication of directions at stairways, underground and interior corridors of a large building. Because in such places there is nearly no natural light, people are unable to see the way under their feet, thus easily leading to a chaotic situation. Objectively, there is a need to have an illuminating lamp, by which the illumination effect is still maintained to a certain extent even after the power turns off. An illuminating lamp having a long afterglow characteristic was thus designed to meet such a requirement.

Presently, the manufacturing process of the illuminating lamp having a long afterglow characteristic is as follows: during the manufacturing of the fluorescent lamp tube, a layer of long afterglow illuminating material needs first to be applied on the interior of the glass tube before the coating of the fluorescent powder. Since the long afterglow illuminating material is coated on the interior of the glass tube, such a procedure for doing so is complex and the requirement for the thickness and the homogeneity of the coating layer is higher. In addition, a high purity long afterglow illuminating material is required because impurities therein will affect the operation of the lamp tube. By using such a method, the manufacturing cost of the fluorescent lamp having the long afterglow characteristic is relatively high.

SUMMARY OF THE INVENTION

To obviate drawbacks of prior art illuminating lamps having a long afterglow characteristic, it is an object of the present invention to provide a long afterglow lamp, which would not require the lamp tube to be specifically made and is simple in structure and is easy in production.

The object of the present invention is achieved by providing a long afterglow lamp, which comprises a lamp body, characterized in that a light penetrating long afterglow rubber sheath is sleeved outside the body, the interior diameter of which is slightly larger than, or equals to, or slightly smaller than the exterior diameter of the lamp body to be sleeved.

The said long afterglow rubber sheath and the lamp body are preferably either identical or similar in shape.

The long afterglow rubber sheath having required sizes and shapes is manufactured from a rubber made by adding a long afterglow fluorescent powder into the rubber in an appropriate ratio.

The long afterglow characteristic of the present invention is realized by sleeving the long afterglow rubber sheath outside the lamp body. It is simple in structure, thus greatly facilitating the manufacturing process and reducing the cost. Ultraviolet light or visible light is absorbed by the long afterglow fluorescent powder in the long afterglow rubber sheath when the lamp body glows; and after the lamp turns off, the long afterglow fluorescent powder in the long afterglow rubber sheath can still keep glowing for more than ten minutes to provide an illuminating or indicating function.

Another embodiment is a long afterglow lamp comprising a lamp body having an exterior diameter, and a long afterglow sheath configured to be mounted over at least a portion of said lamp body, the sheath having a thickness of 0.1 mm to 3 mm, wherein the long afterglow sheath comprises rubber and a light storing powder comprising lead sulfate.

DETAILED DESCRIPTION OF THE PREFERRED EMBODIMENTS

The present invention comprises a lamp body and a long afterglow rubber sheath that is sleeved outside the lamp body. The long afterglow rubber sheath is pervious to light. Its shape is identical to or similar to the lamp body to be sleeved, and the interior diameter of the sheath is slightly larger than or equals to or slightly smaller than the exterior diameter of the lamp body to be sleeved. One end of the sheath can be closed or both ends thereof can be also open.

The long afterglow rubber sheath having required sizes and shapes is manufactured from a rubber made by adding long afterglow fluorescent powder into the rubber in an appropriate ratio. Ultraviolet light or visible light from the light source of the lamp body is absorbed by the long afterglow fluorescent powder in the long afterglow rubber sheath; after the lamp turns off, the long afterglow fluorescent powder in the long afterglow rubber sheath can still keep glowing for a period of time. The preferred rubber sheath material comprises silicon. The long afterglow fluorescent powder is selected from lead sulfate type light storing photoluminescent materials or from aluminum oxide type light storing photoluminescent materials. The amount of the long afterglow fluorescent powder per unit area is determined based on the required afterglow brightness in practical cases, and then the weight ratio of the long afterglow fluorescent powder to the rubber is chosen according to the thickness of the rubber sheath. To obtain a better effect, the ratio of the light storing photoluminescent material to the long afterglow rubber sheath is in the range of 1% to 25% by weight; and the thickness of the long afterglow rubber sheath ranges from 0.1 mm to 3 mm.

Figure 1:
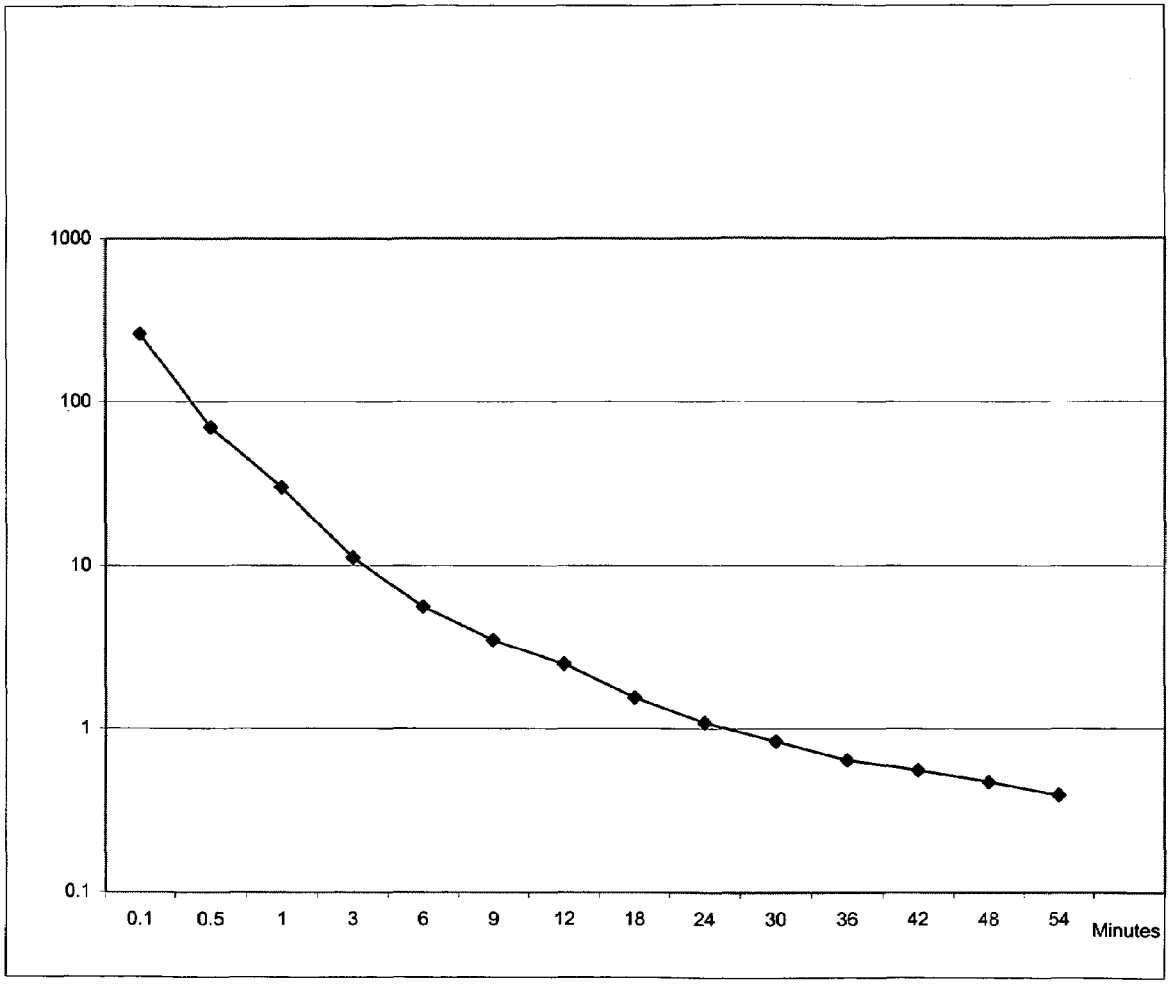
FIG. 1 is an afterglow keeping characteristic curve of the long afterglow lamp of the present invention.

When the lamp body turns off, the afterglow keeping characteristic of the long afterglow rubber sheath is shown in FIG. 1. As seen from FIG. 1, visible fluorescent light can last more than 10 minutes.

EXAMPLE 1

Figure 2C:
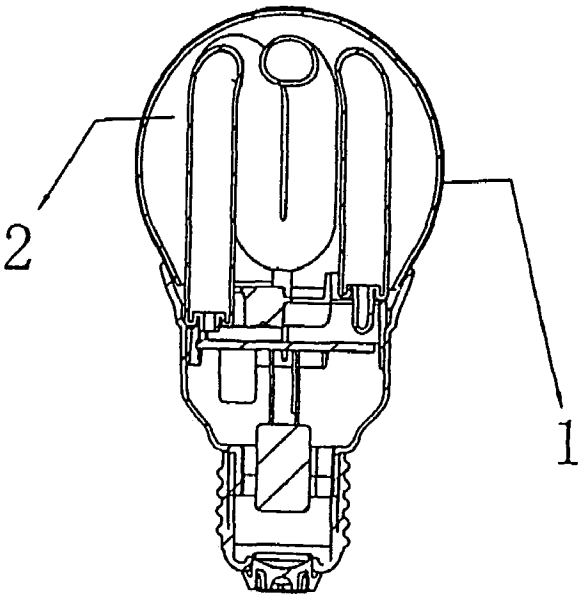
FIGS. 2*a*-2*c* are respectively schematic views of a long afterglow fluorescent rubber sheath, a lamp body and a cross section thereof taken on lines A-A of an embodiment of the present invention.
Figure 2B:
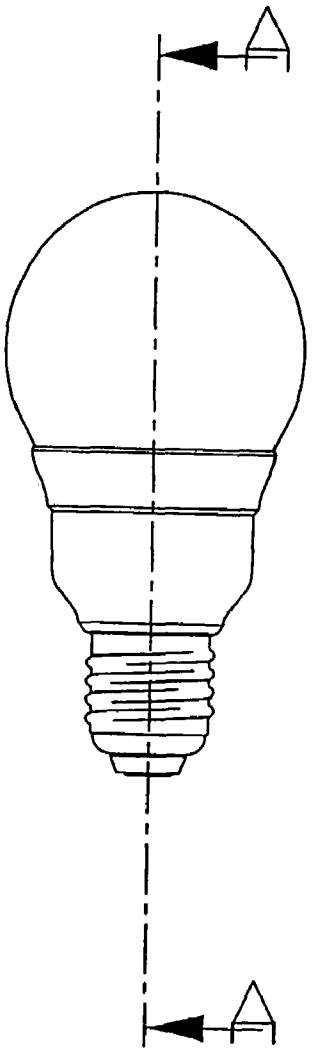
Figure 2A:
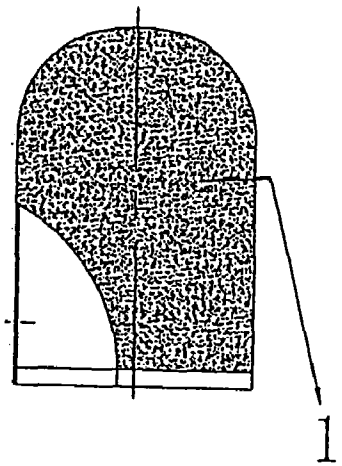

As shown in FIGS. 2*a*-2*c*, a shade type lamp body 2 is introduced in this embodiment. The shape of the long afterglow rubber sheath is also similar to that of the lamp body 2 to be sleeved (as shown in FIG. 2), which is sleeved outside the lamp body 2 (as shown in FIGS. 2*b*, 2*c*), to provide a shade type long afterglow lamp.

EXAMPLE 2

Figure 3C:
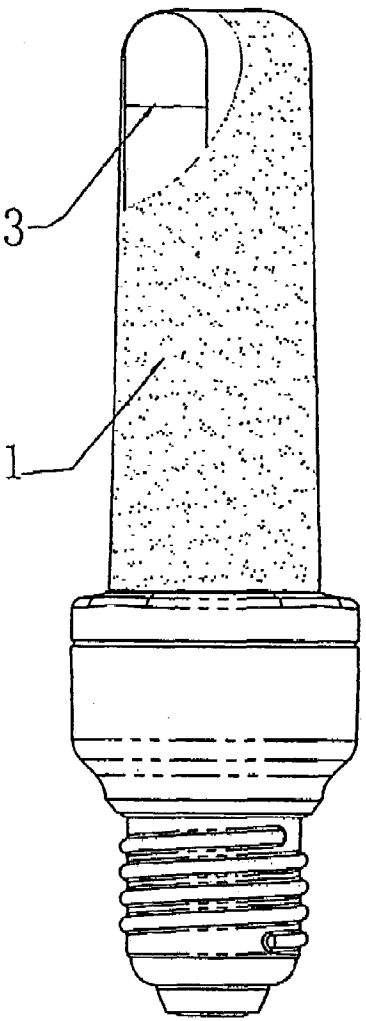
FIGS. 3*a*-3*c* are respectively schematic views of a long afterglow fluorescent rubber sheath, a structure of a lamp body and a long afterglow lamp of another embodiment of the present invention.
Figure 3B:
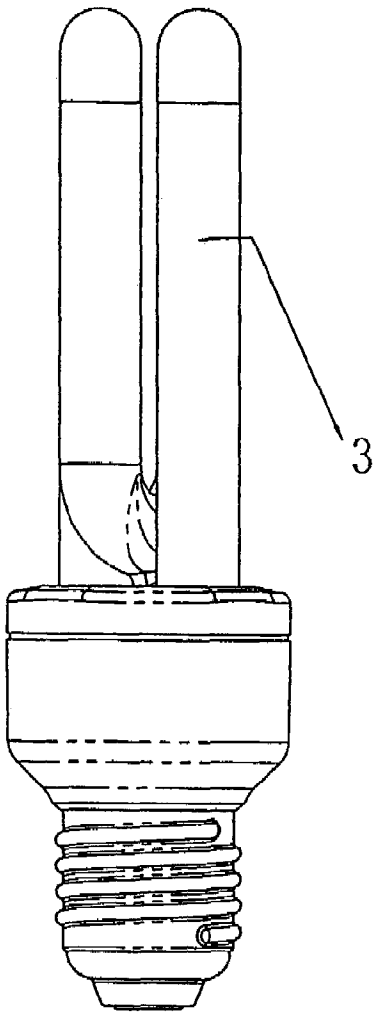
Figure 3A:
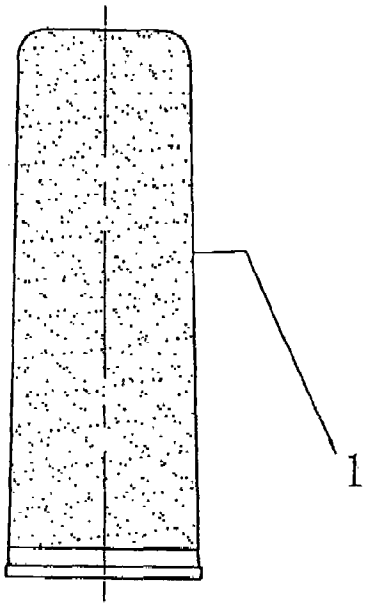

As shown in FIGS. 3*a*-3*c*, the embodiment employs a compact type lamp body 3 that has a two-tube configuration (as shown in FIG. 3*b*). One end of the long afterglow rubber sheath 1 is closed, and another end thereof is open such that the whole of the two tubes of the lamp body 3 is sleeved by the long afterglow fluorescent rubber sheath 1 (as shown in FIGS. 3*a*, 3*c*), to provide a compact type long afterglow lamp having a two-tube configuration.

EXAMPLE 3

Figure 4C:
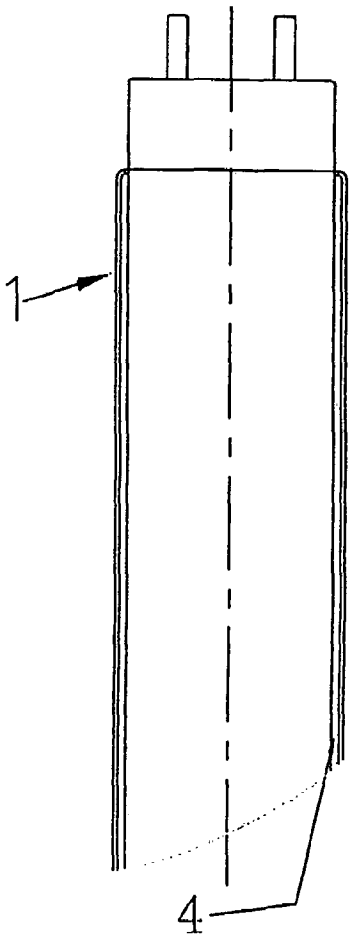
FIGS. 4*a*-4*c* are respectively schematic views of a long afterglow fluorescent rubber sheath and a lamp body, and a partly enlarged view of portion B of a long afterglow lamp of another embodiment of the present invention.
Figure 4B:
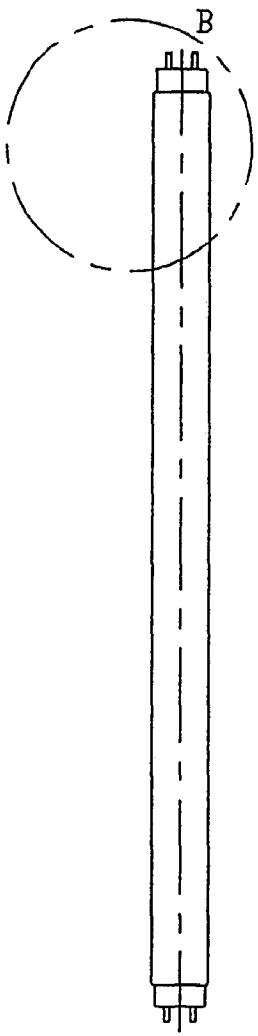
Figure 4A:
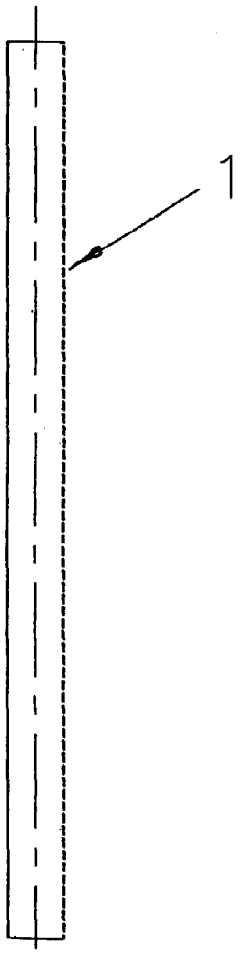

As shown in FIGS. 4*a*-4*c*, the lamp body 3 of the embodiment is of straight tube type. The long afterglow rubber sheath 1 has a hollow tube shape, both ends of which are open (as shown in FIG. 4) such that the straight tube type lamp body 4 is sleeved by said sheath 1 to provide a straight tube type long afterglow lamp.

The above disclosed shapes and configurations of the present invention should be for the purpose of description and should not be regarded as limiting. To match every variety of form of the lamp body to be sleeved, for the long afterglow lamp rubber sheath, many alternatives, modifications and variations can be also made, and are within the scope of the following claims.

What is claimed:

1. A long afterglow sheath for a lamp comprising:

a lamp body having an exterior diameter, and a long afterglow sheath having an interior diameter and two opposed ends, forming a sleeve for at least a portion of said lamp body, said long afterglow sheath being a separate element and sleeved onto said body;

wherein the long afterglow sheath comprises rubber and a light storing photoluminescent material comprising lead sulfate and wherein, before mounting, the sleeve has an, interior diameter which is slightly smaller than the exterior diameter of the lamp body.

2. A long afterglow sheath for a lamp in accordance with claim 1 wherein the long afterglow sheath and the lamp body are similar in shape.

3. A long afterglow sheath for a lamp in accordance with claim 1 wherein the ratio of the light storing photoluminescent material to the long afterglow sheath is in the range of 1% to 25% by weight.

4. A long afterglow sheath for a lamp in accordance with claim 1 wherein the rubber comprises silicon.

5. A long afterglow sheath for a lamp in accordance with claim 1 wherein the thickness of the long afterglow sheath ranges from 0.1 mm to 3 mm.

6. A long afterglow sheath for a lamp in accordance with claim 1 wherein the lamp body is selected from the group consisting of shade type, compact type and straight tube type.

7. A long afterglow sheath for a lamp in accordance with claim 1 wherein one end of the long afterglow sheath is open.

8. A long afterglow sheath for a lamp in accordance with claim 1 wherein both ends of the long afterglow sheath are open.

9. A long afterglow sheath for a lamp in accordance with claim 1 wherein the long afterglow sheath and the lamp body are identical in shape.

10. A long afterglow sheath for a lamp in accordance with claim 1 wherein the photoluminescent material comprises a powder.

11. A long afterglow sheath for a lamp in accordance with claim 1 wherein the light storing photoluminescent material is configured to glow for more than ten minutes after the lamp body is turned off.

12. A long afterglow sheath for a lamp in accordance with claim 9 wherein the lamp body is a shade type lamp body.

13. A long afterglow sheath for a lamp in accordance with claim 9 wherein the lamp body is a compact type lamp body.

14. A long afterglow sheath for a lamp in accordance with claim 9 wherein the lamp body is a straight tube type lamp body.

15. A long afterglow sheath for a lamp comprising:

a lamp body having an exterior diameter, and a long afterglow sheath, said sheath being a separate element and forming a sleeve configured to be mounted over at least a portion of said lamp body, the sheath having a thickness of 0.1 mm to 3 mm, wherein the long afterglow sheath comprises rubber and a light storing powder comprising lead sulfate and the sheath and the lamp body are similar in shape and wherein, before mounting, the sleeve has an inner diameter slightly smaller than the exterior diameter of the lamp body.

16. A long afterglow sheath for a lamp in accordance with claim 15 wherein the light storing powder is configured to glow for more than ten minutes after the lamp body is turned off.

* * * * *